United States Patent [19]

Kirkland et al.

[11] 4,036,295

[45] July 19, 1977

[54] METHOD AND APPARATUS FOR CONNECTING FLOWLINES TO UNDERWATER INSTALLATIONS

[75] Inventors: Kerry G. Kirkland, Houston; Anthony J. Masciopinto, Humble; James H. Owens, Houston, all of Tex.

[73] Assignee: Armco Steel Corporation, Middletown, Ohio

[21] Appl. No.: 679,226

[22] Filed: Apr. 22, 1976

[51] Int. Cl.[2] ..... E21B 7/12

[52] U.S. Cl. ..... 166/.6; 61/69 R; 285/24

[58] Field of Search ..... 166/.5, .6; 61/69 R, 61/110, 107; 285/18, 24, 27

[56] References Cited

U.S. PATENT DOCUMENTS

| | | | |
|---|---|---|---|
| 3,308,881 | 3/1967 | Chan | 166/.6 |
| 3,373,807 | 3/1968 | Fischer et al. | 61/110 X |
| 3,490,792 | 1/1970 | Piegza | 285/24 |
| 3,492,027 | 1/1970 | Herring | 285/18 |
| 3,968,838 | 7/1976 | Baugh | 285/18 |
| R26,668 | 9/1969 | Word et al. | 166/.5 |

*Primary Examiner*—Dennis L. Taylor

*Attorney, Agent, or Firm*—Roylance, Abrams, Berdo & Kaul

[57] ABSTRACT

A flowline is connected remotely to an underwater installation, typically an underwater wellhead, by remote operations carried out from an operational base at the water surface by connecting an end of the flowline to a swivel which has a flow passage coaxial with the axis of rotation of the swivel, guiding the swivel downwardly to a predetermined position at the underwater installation, then remotely connecting the swivel passage to a flow passage of the underwater installation, and then laying out the flowline while allowing the swivel to turn freely, whereby the end of the flowline connected to the swivel is allowed to assume a normal installed position which is not dependent upon a predetermined rotational disposition of the swivel.

14 Claims, 11 Drawing Figures

METHOD AND APPARATUS FOR CONNECTING FLOWLINES TO UNDERWATER INSTALLATIONS

BACKGROUND OF THE INVENTION

With increasing production of oil and gas from offshore locations, there has been a need for the capability, as to both method and equipment, for accomplishing remote connection of flowliness to underwater installations such as wellheads. Numerous problems involved in connecting flowlines to underwater installations at depths too great for practical diver assistance have been apparent, and prior-art workers in the field have proposed a variety of methods and devices for accomplishing such connections. Typical proposals are disclosed in the following U.S. Pat. Nos. Re. 26,668, Word et al, 3,052,299, Geer et al, 3,090,437, Geer, 3,220,477, Jones, 3,233,666, Geer et al, 3,233,667, Van Winkle, 3,308,881, Chan et al, 3,339,632, Lewis, 3,352,356, Wakefield, 3,373,807, Fischer et al. Early flow line connectors and methods involved provision of a connector having a stationary part and a second part capable of being shifted axially into mating engagement with the stationary connector part, one end of the flowline being connected to the second connector part end-to-end and that combination being lowered by vertical guide means, with the second connector part held in horizontal disposition, until the second connector part has been brought into horizontal alignment with the stationary connector part, the second connector part then being shifted horizontally into mating engagement with the stationary part. Such an approach has two disadvantages. First, it is unduly difficult to achieve precise coaxial alignment of the two connector parts remotely, particularly with the flowline attached to a connector part which must be maintained horizontal. Second, in such an arrangement, the fixed horizontal disposition of the connector requires that the adjacent end portion of the flowline also be horizontal after the flowline has been laid out, so that the end portion of the flowline requires mechanical support to protect both the connector and the flowline. In view of those disadvantages, it has been proposed to make a part of the connector pivotable about an axis transverse to the flow path through the connector, so that a part of the connector can be disposed initially in upright, upwardly opening position and a stinger on the end of the flowline can then be lowered into that connector part while the end portion of the flowline extends vertically up to the operational base, laying out of the flowline then causing the connector to pivot to a final position. Though that approach offers advantages, it poses the problem of locking the pivotal connector part in its final position, so that the final position of the pivoted connector must control the disposition of the attached end portion of the flowline, and special mechanical support means is again required. Further, in prior-art approaches of both types, it is usually necessary to employ an internal connector element which shifts axially relative to the rest of the connector, so that an internal recess is caused which may interfere with the travel of pump-down tools. Because of such problems, prior-art methods and equipment, though meritorious, have not been entirely satisfactory.

OBJECTS OF THE INVENTION

One object of the invention is to devise a method and apparatus for remote connection of flowlines to underwater installations, wherein completion of the connecting operation is accomplished by laying out of the flowline along the bottom of the body of water, without requiring that any part of the connector be brought to a predetermined position as a result of laying out the flowline.

Another object is to provide such a method and apparatus which allows the flowline to be disconnected and recovered without disturbing the installation to which it was connected.

A further object is to provide an underwater wellhead installation wherein the flowline can be recovered without disturbing the christmas tree, and the tree assembly can be recovered without disturbing the flowline and its connector.

Yet another object is to devise a method and apparatus for remote connection of a flowline to a wellhead including a christmas tree and a flowloop without requiring that the flowloop be flexed to accomplish connection of the flowline.

A still further object is to devise a method and apparatus for remote connection of a flowline to an underwater installation without the use of a connector which includes a part which must be shifted axially of the flowline to complete the connection with such shifting causing a recess which might interfere with travel of pump-down tools through the connection.

Another object is to provide a method and apparatus for remote connection of a flowline to an underwater installation wherein completion of the operation involves laying of the flowline along the bottom of the body of water, but which does not depend upon the point of connection to the installation being a predetermined distance above the adjacent bottom.

SUMMARY OF THE INVENTION

Broadly considered, the invention is applicable to underwater installations of the type equipped with a permanent guide base on which components of the installation, such as the christmas tree assembly of a subsea wellhead, are to be landed. The method is carried out by landing on the permanent guide base both a flow unit (such as a christmas tree) including a connector with which the flowline is to communicate and a swivel assembly including a swivel having a flow passage which is coaxial with the axis of rotation of the swivel, one end of the flowline having been connected to the swivel and communicating with the flow passage of the swivel, the swivel assembly also including conduit means which can be connected by remote operation to the connector of the flow unit. After the swivel assembly has been landed, its conduit means is connected to the flow unit connector, and the flowline is then laid out, with the swivel turning freely under the influence of the flowline, the final rotational position of the swivel being determined by the final disposition of the end of the end of the flowline attached thereto. Once the connector of the flow unit has been connected to the conduit means of the swivel assembly, the flow path from the flow unit through the swivel to the flowline is continuous regardless of the rotational position of the swivel.

In order that the manner in which the foregoing and other objects are attained according to the invention can be understood in detail, particularly advantageous embodiments of the invention will be described with reference to the accompanying drawings, which form part of the original disclosure in this application, and wherein.

DETAILED DESCRIPTION OF THE METHOD AND APPARATUS EMBODIMENTS OF FIGS. 1–3

Figure 1:
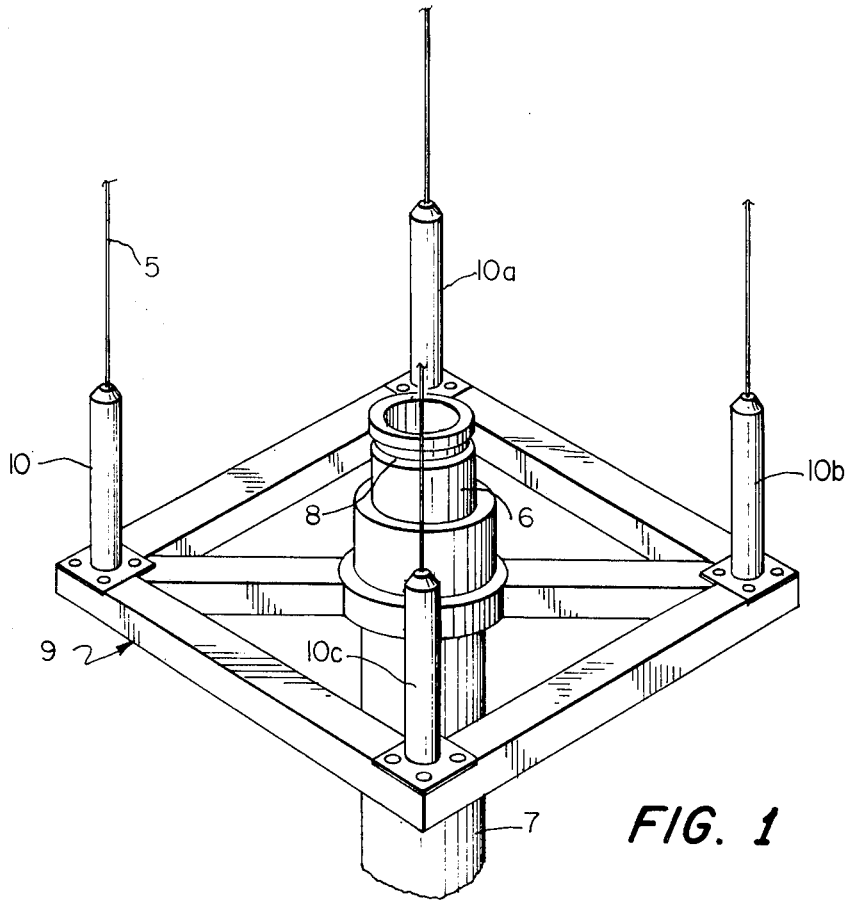
FIGS. 1–1E are semi-diagrammatic perspective views illustrating an underwater wellhead assembly constructed according to one apparatus embodiment and assembled according to one method embodiment of the invention, the figures being sequential, progressing from illustration of the permanent base, in FIG. 1, to illustration of the completed assembly, in FIG. 1E.
Figure 1A:
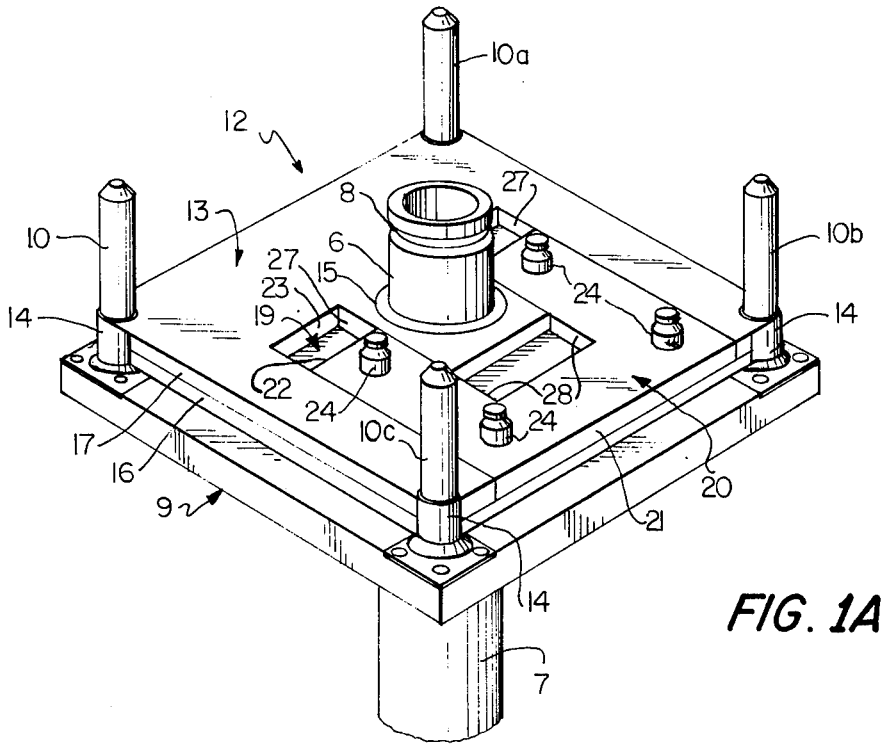
Figure 1C:
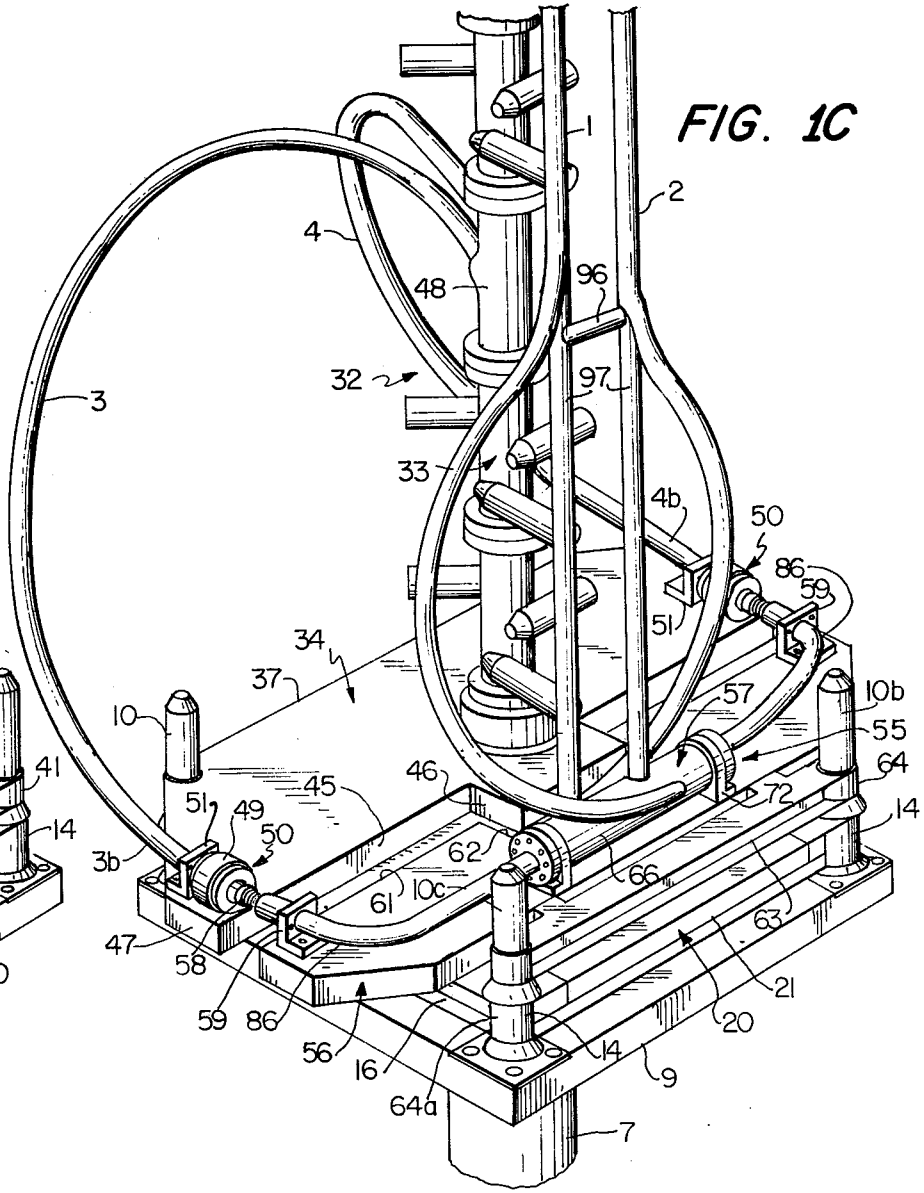
Figure 1B:
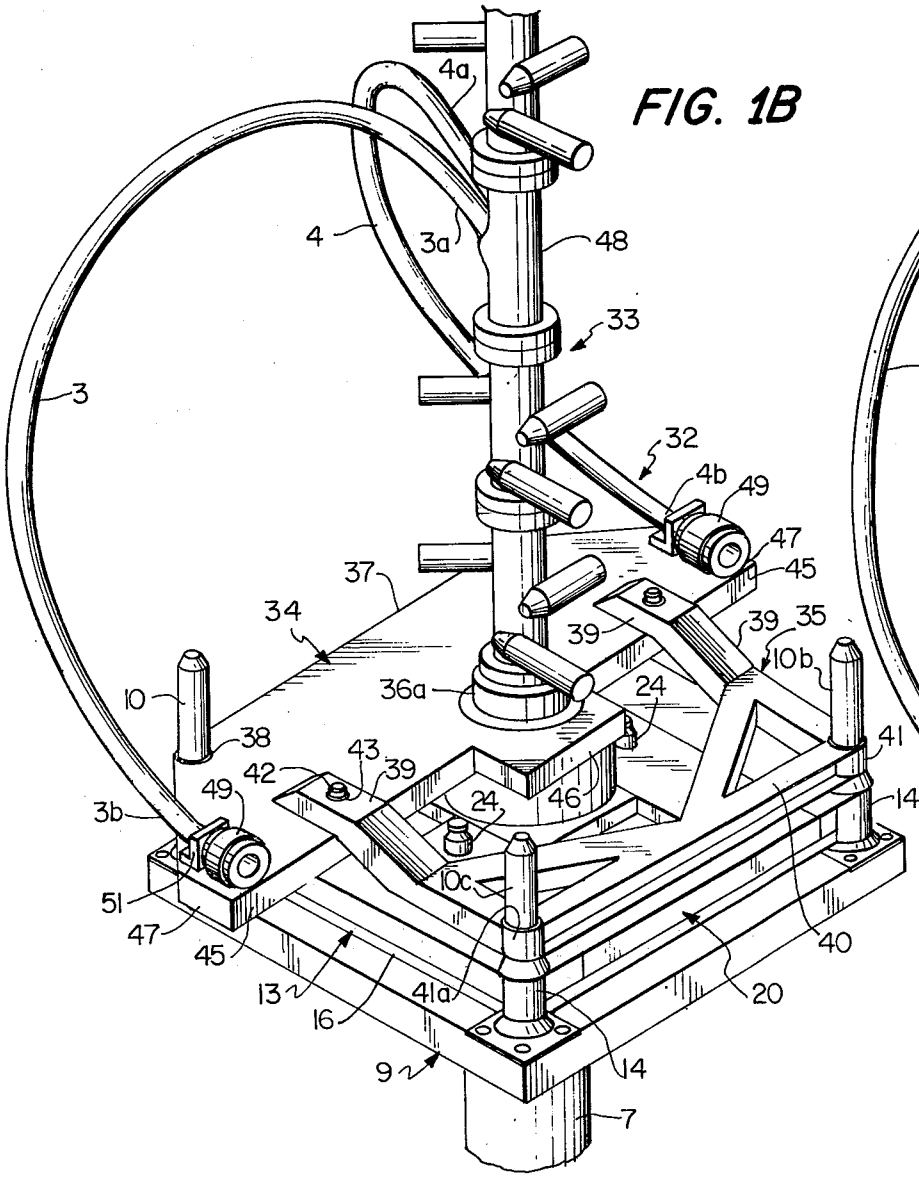
Figure 1D:
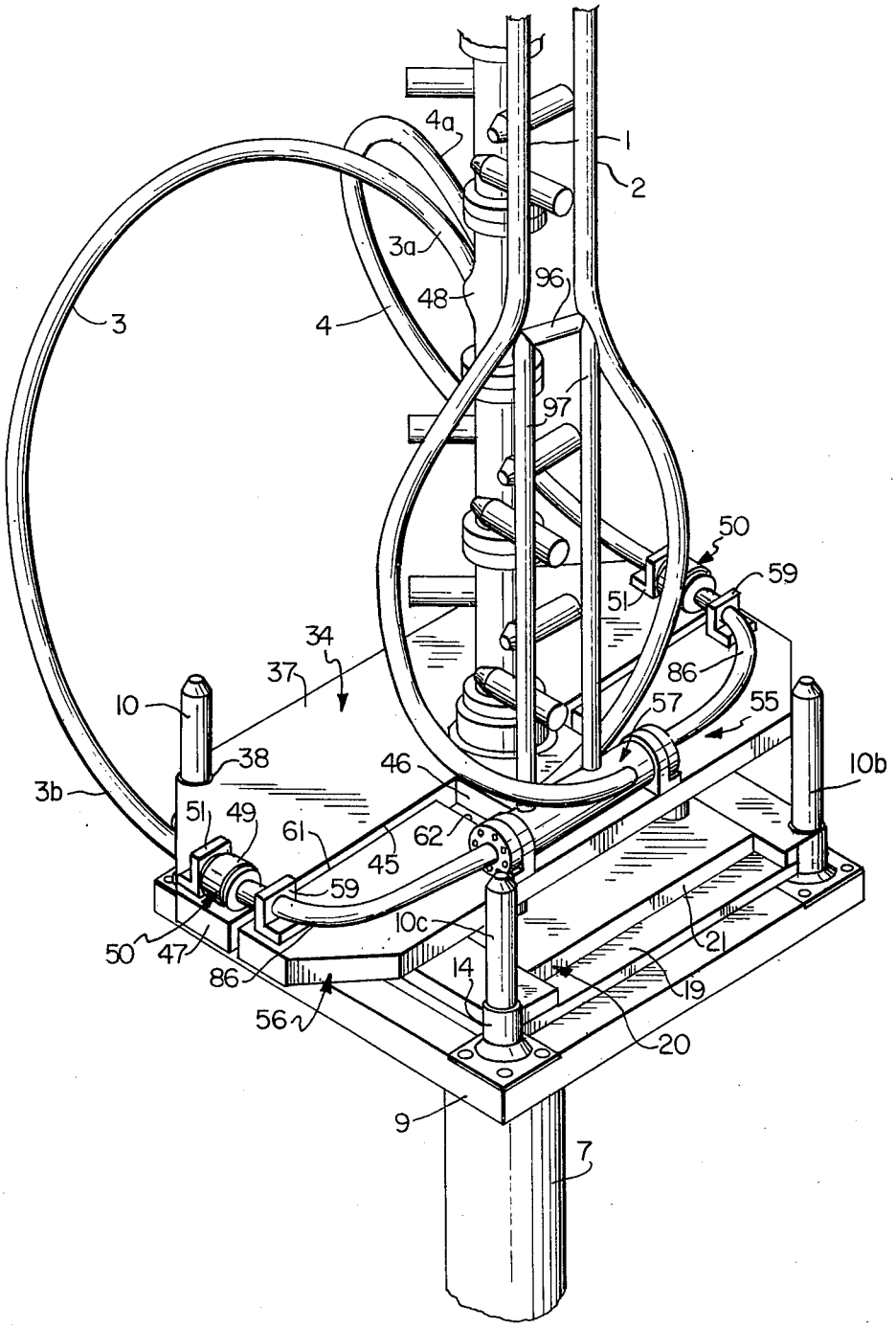
Figure 1E:
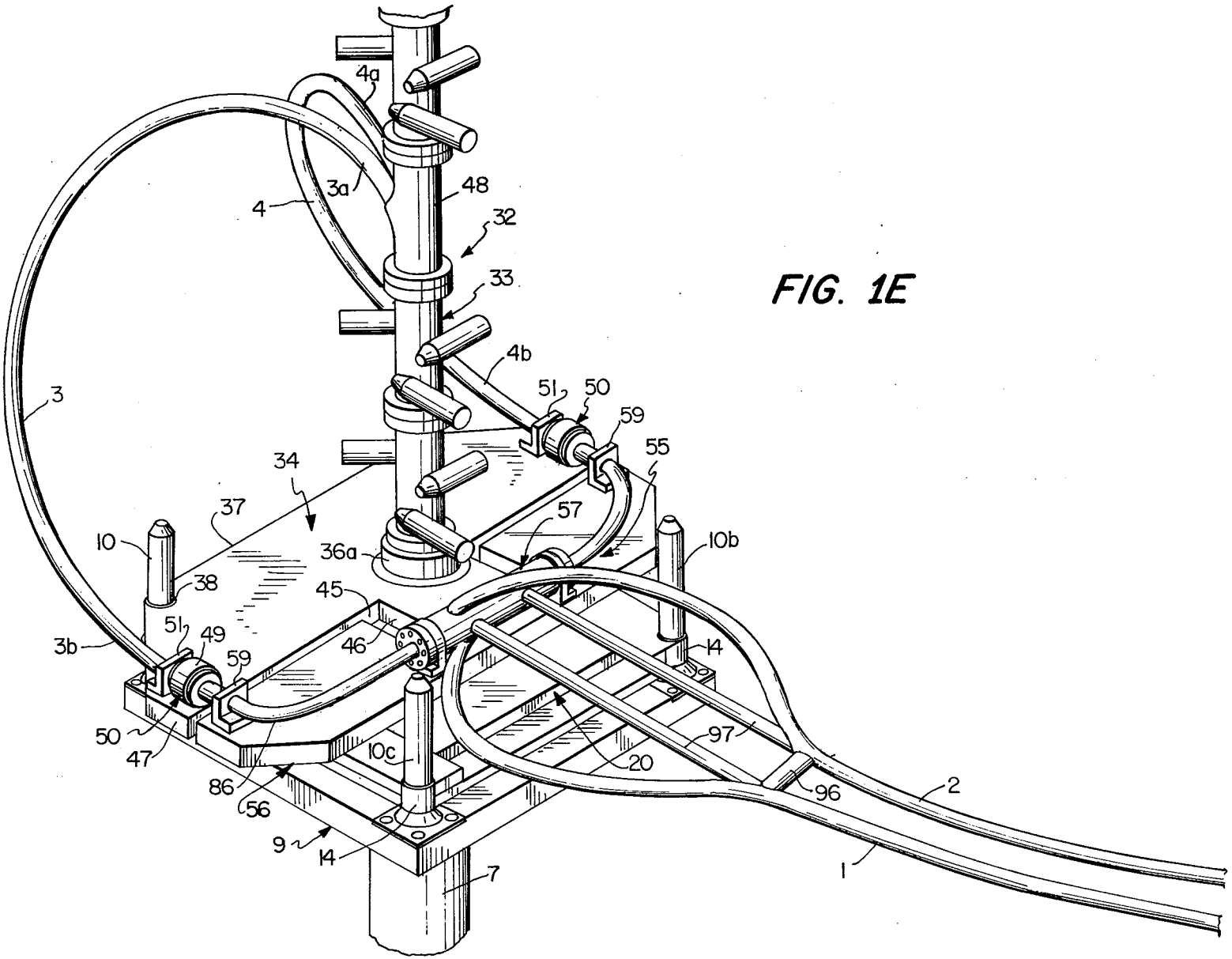
Figure 2:
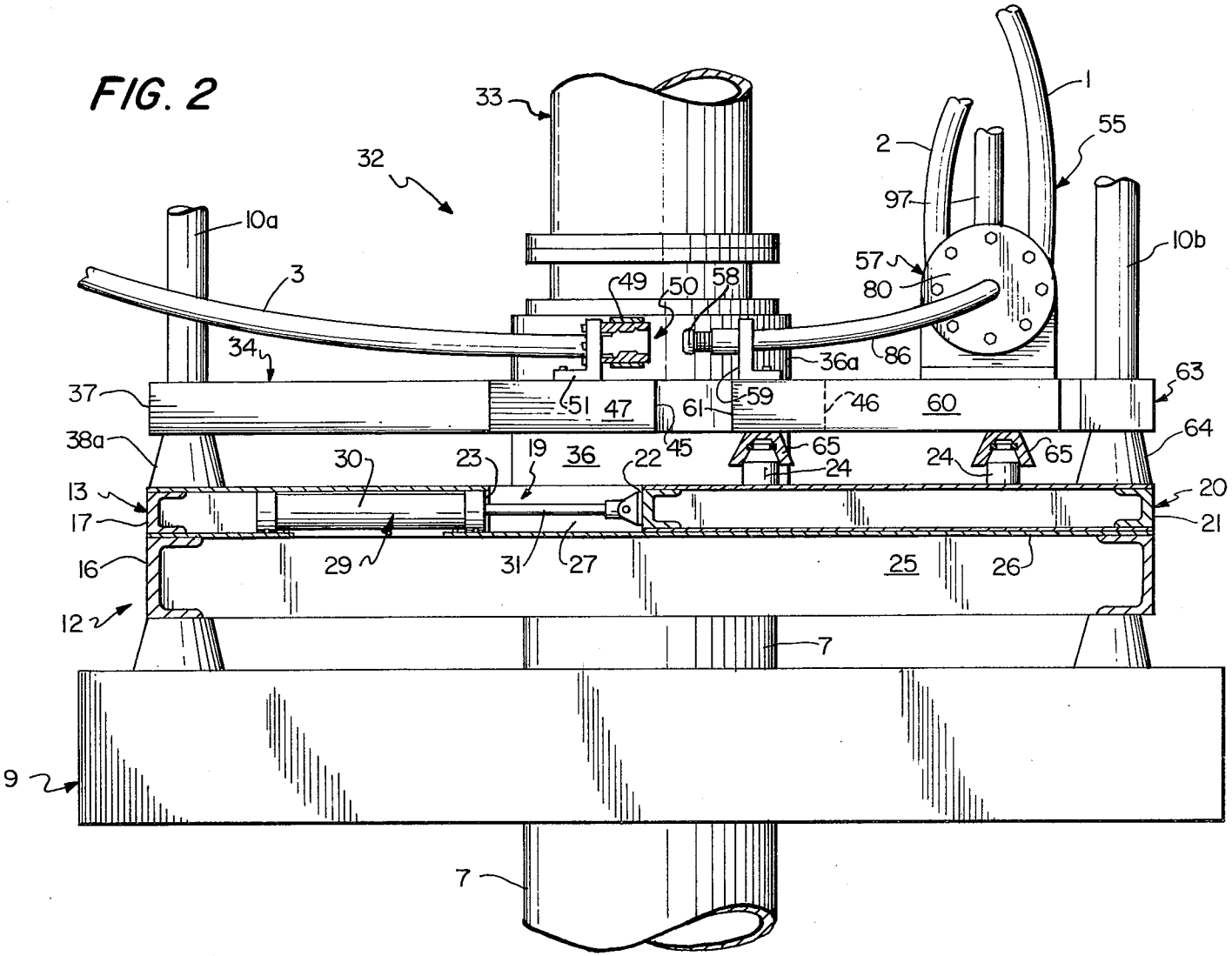
FIG. 2 is a fragmentary view, partly in vertical cross-section and partly in side elevation, illustrating the relationship between the flowline base assembly and the christmas tree assembly of the installation of FIG. 1E, before the flowlines have been connected to the flowloops of the christmas tree assembly.
Figure 3:
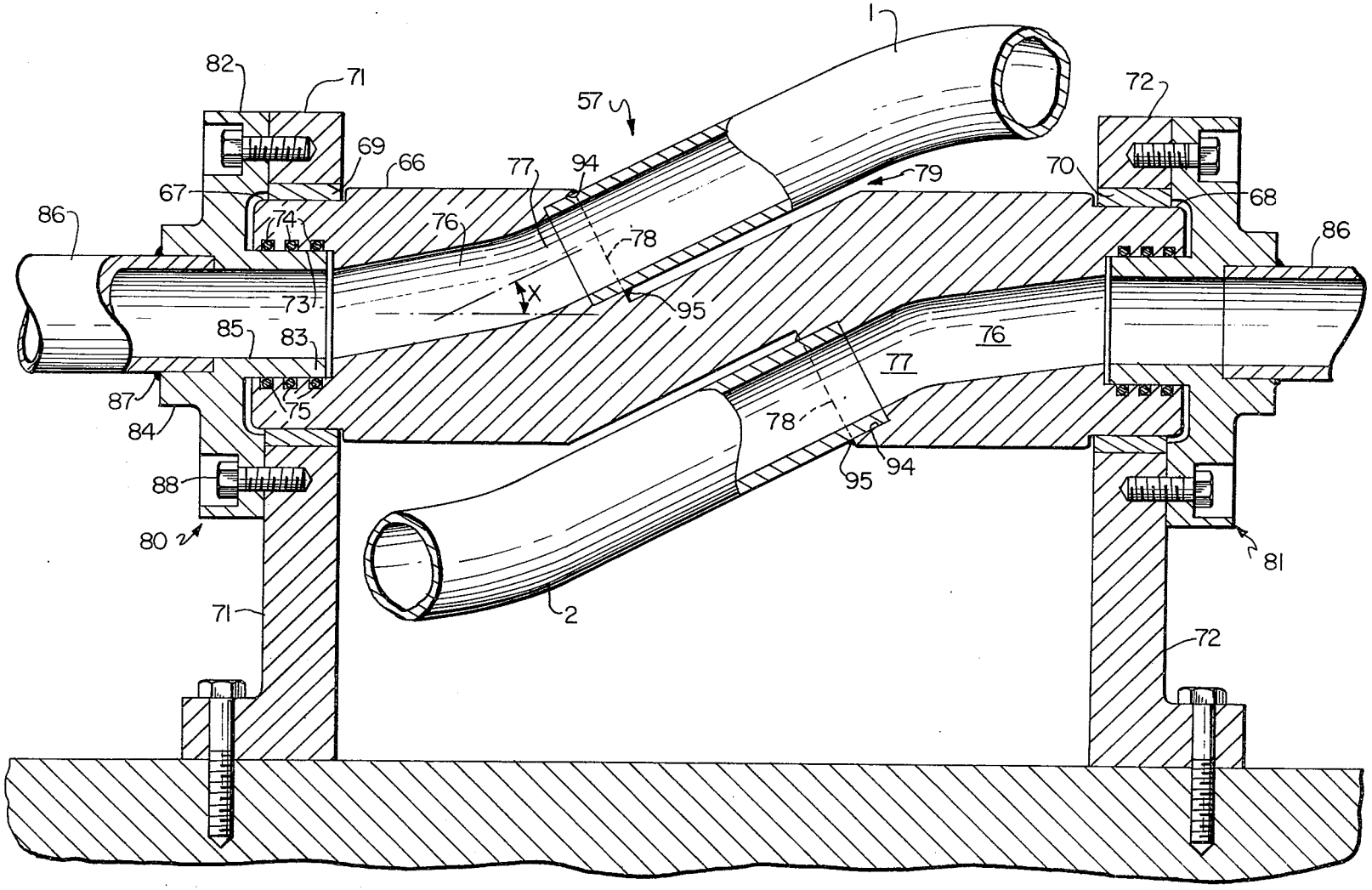
FIG. 3 is a longitudinal sectional view of the swivel employed in the apparatus of FIGS. 1–2.

FIGS. 1–3 illustrate the invention as applied to connection of flowlines 1 and 2, FIG. 1E, to the flowloops 3 and 4, respectively, in a dual string production wellhead assembly which is installed at the bottom of the sea or other body of water, at depth too great for diver assistance, by operations carried out remotely from an operational base, typically an offshore drilling vessel (not shown) with the aid of guide means such as the four guide lines 5, FIG. 1, which extend downwardly from the operational base to the wellhead installation. Suitable guide means, and the manner in which they are used, are disclosed for example in U.S. Pat. No. 2,808,229, issued Oct. 1, 1967, to Bauer et al. As seen in FIG. 1, the installation typically comprises a production body 6 installed conventionally on outer casing 7 and presenting a transverse annular outer locking groove 8 for attachment of the christmas tree as later described. A conventional permanent guide base, indicated generally at 9. is secured to the outer casing below body 6. Guide base 9 is in the nature of a heavy, rigid frame which extends horizontally, is of rectangular shape and is centered with respect to body 6. Four upright locator posts 10–10*c* are included, each located at a different one of the corners of the frame of base 9 and each connected conventionally to a different one of the four guide lines 5.

When body 6 and permanent guide base 9 have been installed, the method is carried forward by installing on permanent guide base 9 a flowline base assembly indicated generally at 12, FIG. 1A. The flowline base assembly 12 comprises a main frame 13 which is similar in plan to guide base 9 but slightly smaller, as shown, each corner of the main frame being equipped with a rigidly secured upright guide and locator tube 14, the tubes 14 being positioned to cooperate with locator posts. When the flowline base assembly is at the surface of the body of water, preparatory to installation, each tube 14 is placed about a different one of the four guide lines 5 and the flowline base assembly is lowered along the guide lines, using conventional handling tools, until the tubes 14 engage respectively over the locator posts 10 and the flowline base assembly is fully landed on the permanent guide base. At its center, the flowline base assembly has a circular opening 15 dimensioned to accommodate the upper end of the outer casing 7.

As seen in FIGS. 1A and 2, the main frame 13 of flowline base assembly 12 comprises a lower structure 16 which is complete and rigid throughout the entire rectangular plan area of the flowline base assembly, and an upper structure 17 which defines an upwardly opening, horizontally extending recess 19 of generally squared U shape, the two arms of the U of recess 19 extending each on a different side of opening 15. Assembly 12 also comprises a secondary frame 20 which corresponds in plan shape to that of the recess 19 and is disposed therein. Recess 19 opens outwardly through one side of upper structure 17, as shown. The length of the legs of the U of secondary frame 20 is less than that of the legs of the U of recess 19 so that, when the outer edge of the U of the secondary frame is aligned above the corresponding side edge of lower structure 16, there are substantial spaces between the ends of the legs of frame 20 and the ends of the legs of recess 19. Secondary frame 20 is mounted on main frame 13 in such fashion that the secondary frame can be shifted rectilinearly in both directions parallel to the legs of the U of recess 19, between a first position (FIGS. 1A and 2), in which the outer edge or base 21 of frame 20 is aligned with the corresponding outer side of main frame 13 and the ends 22 of the legs of the secondary frame are spaced from the ends 23 of the legs of recess 19, and a second position (FIGS. 1D and 1E), in which the ends 22 of the secondary frame are adjacent the ends 23 and the outer edge of base 21 is spaced inwardly from the corresponding outer side of main frame 13. Secondary frame 20 is equipped with four upwardly projecting locator posts 24, two of which are located respectively at the free ends of the legs of the frame and the other two of which are located at the ends of base 21 of the secondary frame, as best seen in FIG. 1A.

Slidable mounting of secondary frame 20 on main frame 13 can be accomplished in any suitable fashion. In this embodiment, lower structure 16 of main frame 13 comprises a plurality of parallel horizontal beams 25 located beneath the area occupied by the secondary frame, beams 25 being equipped with corrosion resistant upper surface members 26, FIG. 2, and the secondary frame being seated directly on members 26 and thus supported by beams 25. The structural members defining sides 27 of the legs of the U of recess 19 carry corrosion resistant surface members which are disposed in free sliding engagement with like surface members on the structural members which define the sides 28 of the legs of the secondary frame 20. It is thus apparent that, though horizontally shiftable, secondary frame 20 is constrained to accurately predetermined positions relative to main frame 13 and the locator posts 10 of the permanent guide base.

Housed within upper structure 17 of main frame 13, and rigidly mounted on frame 13, are two rectilinear power devices 29 of any conventional type suitable for moving secondary frame 20 between its two extreme positions in response to control actions taken at the operational base at the water surface. Power devices 29 can be fluid pressure operated, e.g., hydraulically operated, piston-and-cylinder devices, with the cylinders 30 mounted on main frame 13 each in a location at the end of and aligned with a different one of the legs of the U of recess 19, the piston rods 31 extending toward the respective ends of the legs of secondary frame 20 with the free ends of the piston rods being pivotally connected to the ends of the legs of the secondary frame. Power devices 29 are so constructed and arranged that, upon remote operation of the power devices to extend piston rods 31, secondary frame 20 is shifted outwardly and located precisely at its predetermined first position, with locator posts 24 then occupying predetermined positions relative to the locator posts of permanent guide base 9.

The next step of the method is to install the flow unit, in this embodiment the christmas tree assembly 32, FIG. 1B, including christmas tree 33, tree frame 34, retrievable two-arm guide unit 35, and flowloops 3 and 4. Tree frame 34 is a unitary rigid structure of a plan shape to overlie one half of permanent guide base 9, yet rigidly support the remotely operated connector 36 which constitutes the bottom of tree assembly 33. In this embodiment, frame 34 has a straight outer side 37 extending between locator tubes 38 and 38*a* which are built into the frame at respective locations proper to coact with the two guide lines 5 connected to locator posts 10 and 10*a* of the permanent guide base.

The retrievable guide unit 35 is of generally U-shaped plan configuration and is a rigid structure including members 39, forming the legs of the U of the guide unit, and member 40, which forms the base of the U. Guide and locator tubes 41 and 41*a* are mounted rigidly on unit 35, each at a different end of member 40, and are so positioned as to cooperate respectively with guide posts 10*b* and 10*c* and the guide lines 5 connected to those guide posts. The free ends of members 39 overlap frame 34 and are releasably but rigidly secured thereto in any conventional fashion. Thus, frame 34 can be equipped with two upright posts 42, FIG. 1B, each extending through a different one of two connector sleeves 43 carried by the respective members 39, posts 42 having locking grooves and sleeves 43 being equipped with spring urged shearable latch members (not shown) of the type disclosed for example in U.S. Pat. No. 3,268,239, issued Aug. 23, 1966, to Castor et al. It will be apparent that, with members 39 thus secured to frame 34 at the operational base, the christmas tree assembly 32 can be lowered along guide lines 5 until landed in the position seen in FIG. 1B, the connector 36 can then be locked up by remote operation to secure the tree to body 6, and guide unit 35 can then be disconnected from frame 34 by applying an upward strain with suitable handling tools, the guide unit 35 being withdrawn to the surface, leaving secondary frame 20 of flowline base assembly 12 completely exposed for further operations carried out from above.

Opposite side 37, frame 34 has two aligned side portions 45 which each extend radially relative to connector 36. At the location of connector 36, frame 34 includes a horizontally offset portion 46 which projects outwardly from the side of the frame defined by portions 45, so that the frame can define a circular opening accommodating portion 36*a* of the connector. Connector 36 can be of the type disclosed in U.S. Pat. No. 3,228,715, issued Jan. 11, 1966, to Neilon et al. and is rigidly secured to frame 34. The dimension of frame 34 along the side defined by portions 45 is greater than the corresponding width of the permanent guide base 9. Accordingly, portions 47, FIG. 1B, of frame 34 extend beyond the guide base. Flowloops 3 and 4 each have one end connected to the diverter spool 48 of the christmas tree, as indicated at 3*a* and 4*a* respectively, and extend arcuately in such fashion that the other ends 3*b* and 4*b* of the flowloops are located each above a different one of the overhanging portions 47 of frame 34 and extend horizontally toward the location of secondary frame 20. Flowloop end portions 3*b* and 4*b* are mutually parallel and each end portion is connected to the female unit 49 of a different one of two remotely operated connectors 50 which are rigidly mounted on frame 34, as by brackets 51. Connector units 49 are so arranged that the cavities they define constitute horizontal extensions of the repective flowloop ends, the central axes of the connector units 49 lying in the same horizontal plane. Connectors 50 can be miniaturized versions of that disclosed in U.S. Pat. No. 3,228,715.

After retrievable guide unit 35 has been removed, the method is continued by guiding down lines 5 and landing on the secondary frame 20 a swivel assembly indicated generally at 55, FIGS. 1C and 2. Assembly 55 comprises a swivel frame 56, a swivel 57 and the male units 58 of connectors 50, connector units 58 being in the nature of stingers rigidly supported on frame 56, as by brackets 59. Frame 56 is in the form of a flat, rigid main structure 60 having straight side edge portions 61 respectively opposed to side portions 45 of frame 34, a notch 62 being provided to accommodate the offset portion 46 of frame 34. Releasably attached to frame 56, in the manner hereinbefore described with reference to guide unit 35, is a retrievable guide unit 63, FIG. 1C, carrying guide and locator tubes 64 and 64*a* which are so arranged as to cooperate with locator posts 10*b* and 10*c* of permanent guide base 9 and with guide lines 5 connected to those posts. Four dependent, downwardly opening locator and connector members 65, FIG. 2, are rigidly secured to structure 60 of frame 56 and are so located that, when locator tubes 64, 64*a* engage over posts 10*b* and 10*c*, respectively, each of the members 65 engages over a different one of the locator posts 24 on secondary frame 20 of the flowline base assembly. Mounted rigidly on structure 60 and located thereabove, swivel 57 comprises a rotary block 66, FIG. 3, having right cylindrical end portions 67, 68 journalled respectively in sleeve bearings 69 and 70, the sleeve bearings being carried by support brackets 71 and 72. At each of its ends, rotary block 66 has an axial bore 73 of a diameter somewhat larger than the outer diameter of flowlines 1 and 2, bore 73 being provided with transverse annular grooves 74 which accommodate O-rings 75, or other suitable seals. At its inner end, each bore 73 opens into a bore 76 which in turn joins a bore 77, the latter opening outwardly through wall 78 of notch 79. Each bore 77 extends at an acute angle $x$ to the axis of block 66.. The swivel is completed by two identical end plates 80 and 81, only end plate 80 being being described in detail. End plate 80 has a flat circular main body 82, a centrally disposed right cylindrical tubular extension 83, and a tubular hub 84 which is coaxial with extension 83 and located on the side of body 82 opposite the extension. An axial bore 85 extends centrally through extension 83, body 82 and hub 84. Through extension 83 and a portion of main body 82, bore 85 has a diameter equal to the diameter of bore portions 76 and 77 and flowlines 1 and 2. At its opposite end, the diameter of bore 85 is enlarged to accomodate one end portion of tube 86 which is identical to flowlines 1 and 2, tube 86 being inserted into hub 84 and secured by weld 87. End plate 80 is secured to bracket 71, as by cap screws 88.

Tubes 86 entend horizontally and are curved through 90°, as seen in FIG. 1C, so that the ends 87 thereof opposite the swivel lie in a common plane, are mutually parallel, and open toward the tree 34 after assembly 55 has been landed. Ends 87 are each connected to a different one of the male connector units 58. The positions of brackets 59 are such that, when the swivel assembly has been landed, with connector members 65 locked to locator posts 24, each unit 58 is aligned coaxially with a different one of the female connector units 49. As seen in FIG. 2, stingers 58 project beyond side portions 61 of frame structure 60, and female connector units 49 similarly project beyond side portions 45 of tree frame 34 so that, when power devices 29 are operated to move secondary frame 20 toward tree frame 34, stingers 58 are inserted positively and fully into connector units 49. the connectors 50 then being locked by remote control. Connectors 50 can be unlocked by remote operation so that secondary frame 20 can be moved back to the right (as viewed in FIG. 2) to withdraw stingers 58 preparatory to independent recovery of either christmas tree assembly 32 or swivel assembly 55. Connector members 65 and locator posts 24 coact not only for accurate location of swivel frame 56 on secondary frame 20 but also as releasable lock means to secure the swivel assembly to the secondary frame. Thus, each post 24 can be provided with a transverse locking groove to cooperate with spring urged shearable latch members carried by connector members 65, in the manner disclosed in U.S. Pat. No. 3,268,239.

At each notch 79, a counterbore 94 is provided through wall 78 to accommodate the end portions of the respective flowlines, the flowline ends being rigidly secured to swivel block 66 by welds 95. The flowline end portions are coaxial with the respective bore portions 77 so as to extend initially outwardly and away from the swivel block as the acute angle *x*. As seen in FIG. 1C, flowlines 1 and 2 then curve arcuately away from the swivel and then extend along a line transverse to the axis of rotation of the swivel so that, within a distance of a few feet from the swivel, the flowlines extend side-by-side in mutually parallel, closely spaced relation. At the junctures between the parallel portions and the curved portions of the flowlines, the flowlines are mechanically joined by a straight cross-brace 96, FIG. 1C, and parallel longitudinal stiffening braces 97 are also provided, each extending from a different end of cross-brace 96 to swivel block 66. Braces 96 and 97 are welded in place.

The swivel assembly 55 is made up on the operational base at the water surface, including installation of block 66 to which flowlines 1 and 2 have been attached. As seen in FIG. 1C, landing of the swivel assembly is accomplished with secondary frame 20 in its outer-most position and with flowlines 1 and 2 extending upwardly to the operational base. When the swivel assembly is first landed, piston rods 31 are extended and stingers 58 are therefore spaced from female connector units 49. The next step of the method is to operate power devices 29 to shift secondary frame 20 inwardly, causing stingers 58 to be inserted in connector units 49, connectors 50 then being locked remotely, the flowline base assembly and the swivel assembly now being in the positions seen in FIG. 1D. It is to be noted that, at this stage, flowlines 1 and 2 are connected respectively to flowloops 3 and 4 via swivel block 66, tubes 86, and connectors 50 and that such connection has been accomplished without requiring flexing of the flowloops and without creating any internal recesses which might interfere with travel of pump-down tools along the flow paths. From FIG. 3, it will be understood that, for each flowline, a part of the flow path, established by tube 86 and bore 85, is coaxial with the axis of rotation of swivel 57, and that the swivel is completely free to turn without having any affect on the ability of the flow paths to conduct fluid between the well and the flowlines.

The final step of the method is to lay the flowlines 1 and 2 out along the bottom of the body of water, this being accomplished, e.g., by moving a lay barge (not shown) away from the operational base while paying out the flowlines. As the flowlines are thus laid out, swivel block 66 rotates about the axis determined by bearings 69 and 70, such rotation being caused by movement of the flowlines and continuing until the flowlines are at rest on the bottom of the body of water and the portions of the flowlines adjacent the wellhead assembly have assumed a natural catenary determined inherently by the characteristics of the flowlines, the elevation of swivel 57 above the bottom, and the configuration of the bottom adjacent the installation. It will be noted that it is completely unnecessary either to stop swivel block 66 in a predetermined rotational position or to support the portions of the flowlines adjacent the swivel, since the flow paths through the combination of the swivel block and tubes 86 are completely unaffected by the rotational position of the swivel block.

THE EMBODIMENT OF FIGS. 4–4D

Figure 4:
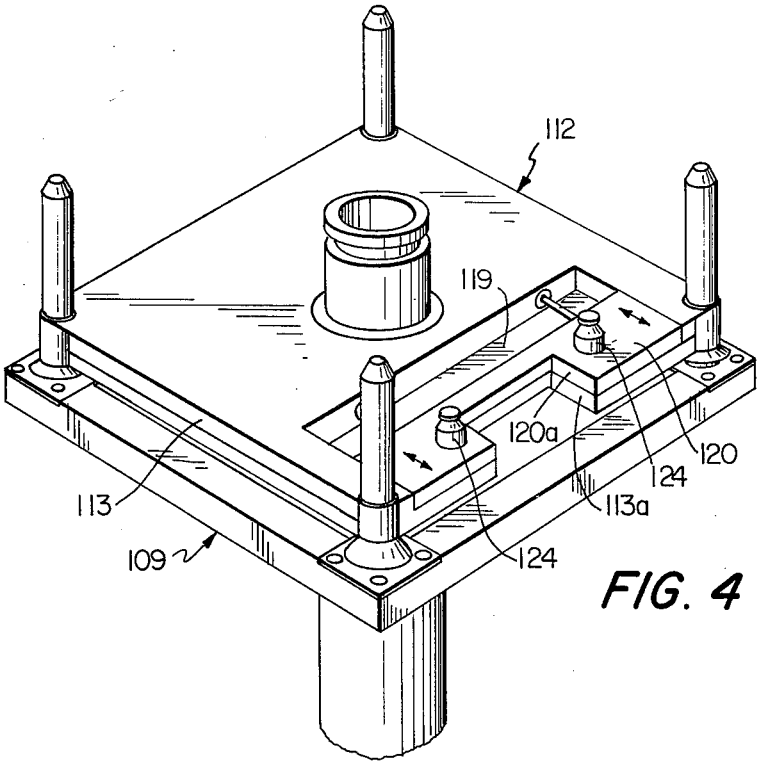
FIGS. 4–4D are semi-diagrammatic perspective views illustrating an underwater wellhead assembly constructed and assembled according to another embodiment of the invention, the figures being sequential, progressing from landing of the flowline base, in FIG. 1, to the completed assembly, in FIG. 4D.
Figure 4A:
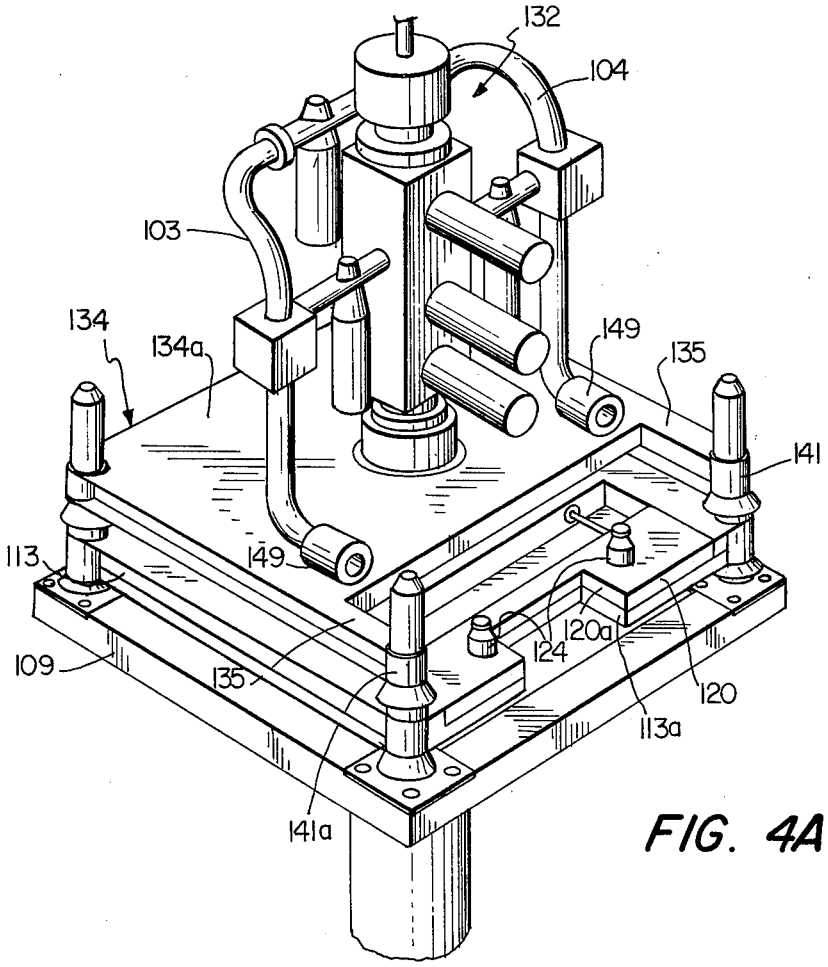
Figure 4B:
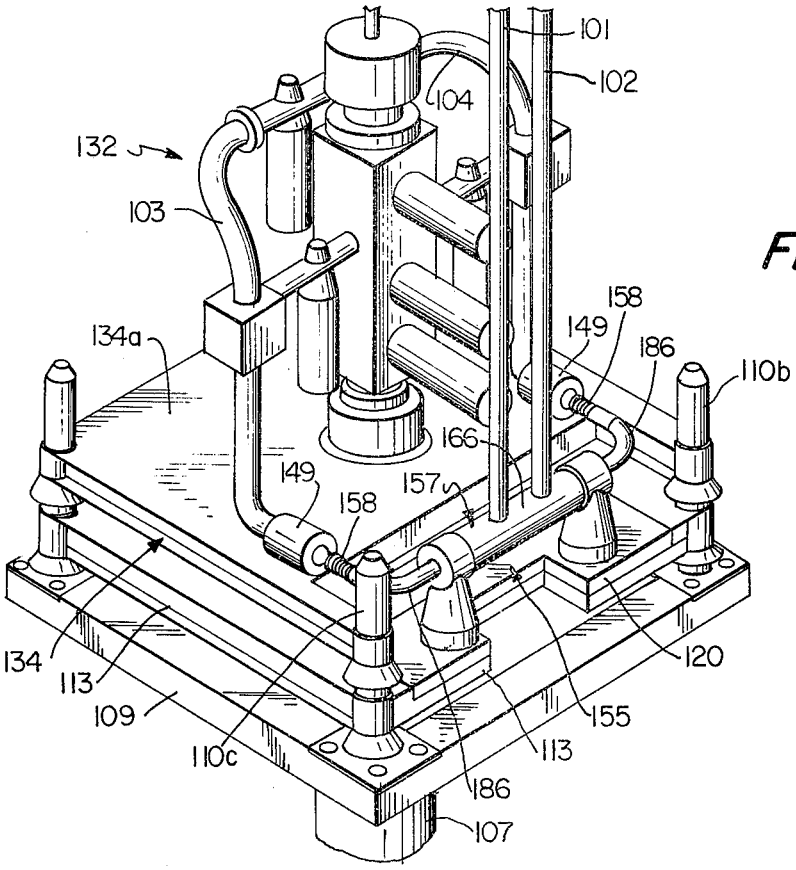
Figure 4C:
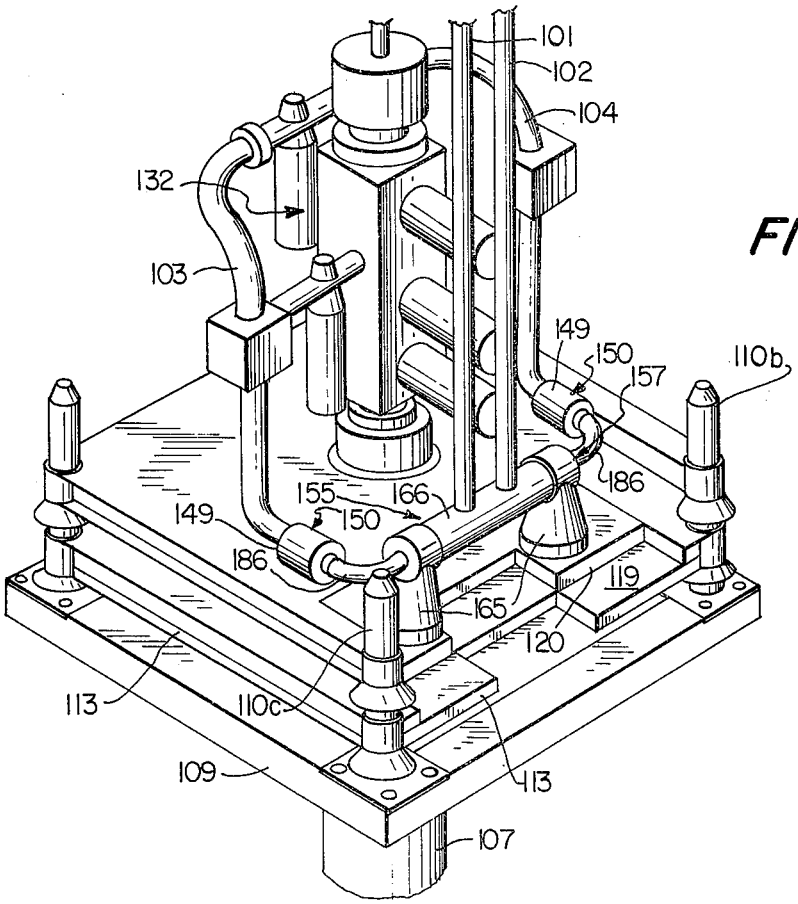
Figure 4D:
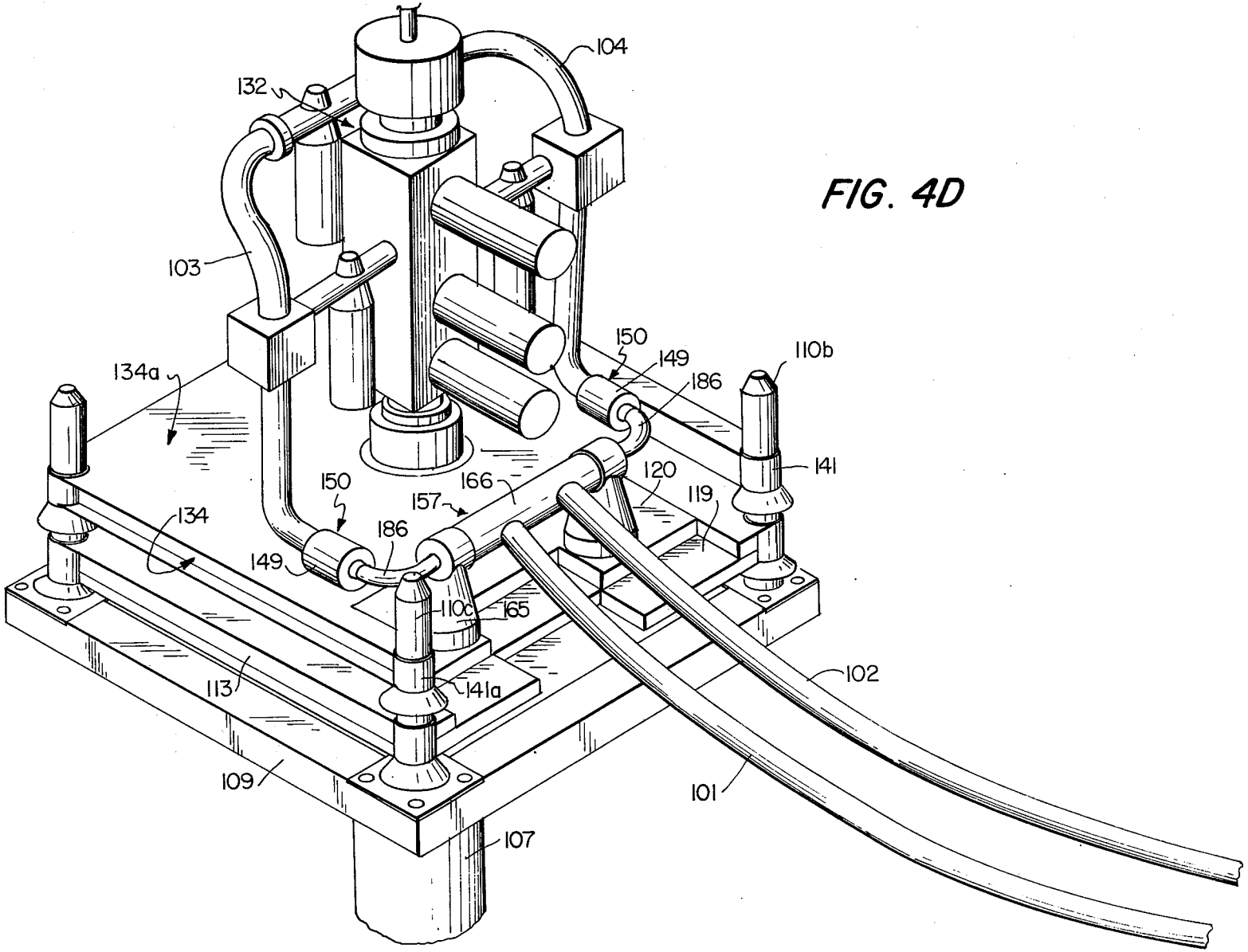

FIGS. 4–4D illustrate the invention as applied to an underwater well installation of the type in which the dual string wellhead is not adapted for pump-down tools. Here, the permanent guide base 109 is identical to guide base 9, FIG. 1 and is installed conventionally. Flowline base assembly 112 includes a main frame 113 and a simple rectangular secondary frame 120 shiftable on the main frame within a rectangular recess 119 wholly at one side of the surface casing, power devices (not shown) being provided, for shifting secondary frame 120, as hereinbefore described with reference to power devices 29 of the embodiment of FIGS. 1–3. Both main frame 113 and secondary frame 120 are provided with outwardly opening notches **113*a* and 120*a*, respectively, to provide increased clearance for flowlines 101, 102. Secondary frame 120 is equipped with only two locator posts 124**.

In this embodiment, the christmas tree assembly 132 includes simple flow branches 103 and 104, each terminating in the female connector unit 149 of a different one of two connectors 150, units 149 being rigidly mounted on the main body **134*a* of tree frame 134. The tree frame includes two arms 135 each carrying a diffferent one of locator tubes 141 and 141*a*, it thus being unnecessary in this embodiment to employ the retrievable two-arm guide unit of the flowline base assembly of FIGS. 1–3**.

The swivel assembly 155 comprises a swivel 157, a retrievable guide unit (not shown) carrying locator tubes to cooperate with guideposts **110*b* and 110*c*, stingers 158, and tubes 186 interconnecting the swivel and the stingers. Swivel assembly 155 carries dependent connectors 165, equivalent to connectors 65, FIG. 2, for cooperating with locator posts 124 to secure the swivel assembly to secondary frame 120. Swivel block 166 turns freely about its axis and defines flow ducts coaxial with its axis of rotation. Flowlines 101 and 102 are connected at right angles to the swivel block, the flow ducts in the block turning at right angles since passage of pump-down tools is not required. Installation is generally as described with reference to the embodiment of FIGS. 1-3.**

THE EMBODIMENT OF FIGS. 5 AND 6

Figure 5:
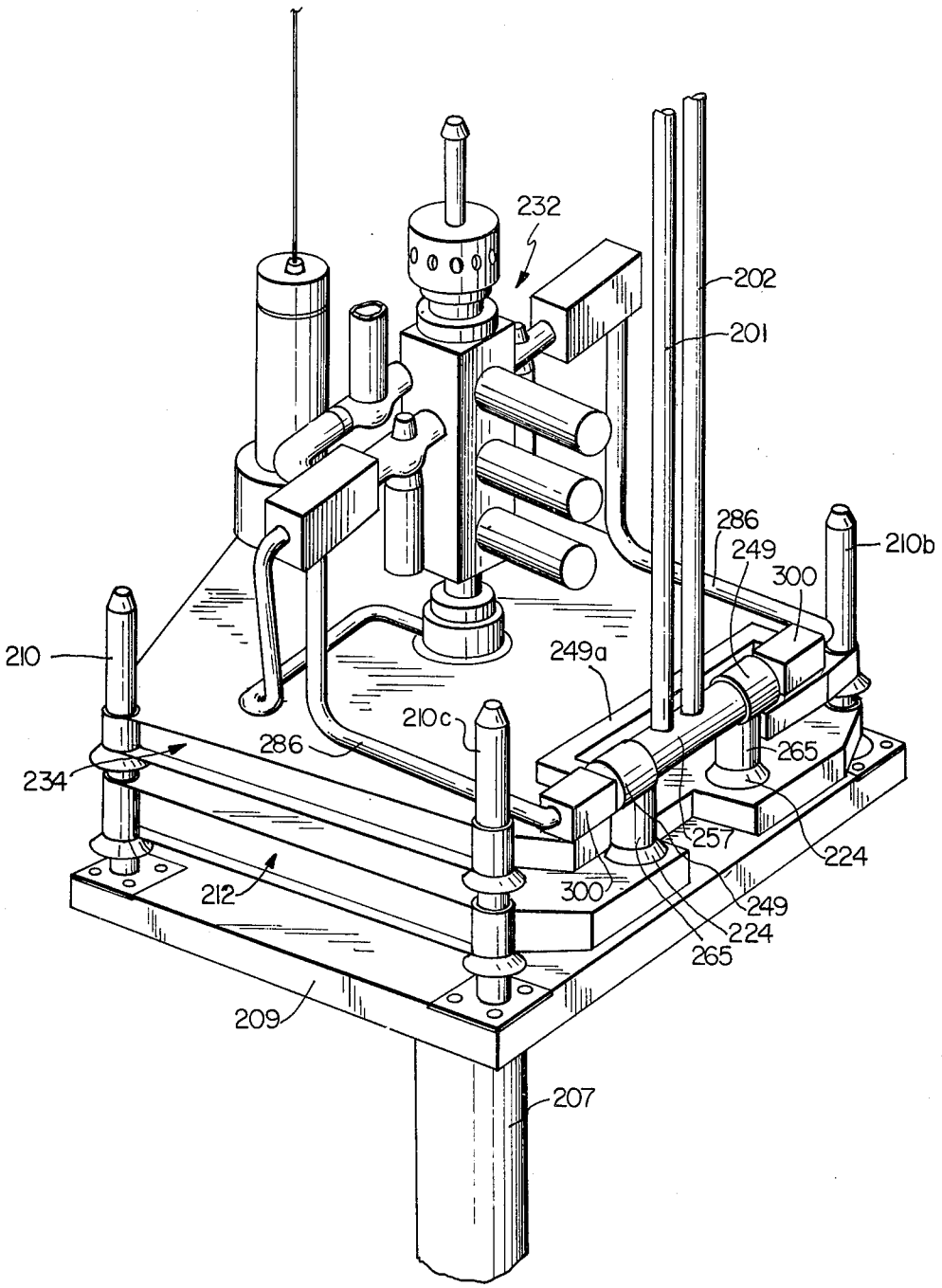
FIG. 5 is a perspective view of an assembled underwater wellhead assembly according to a further embodiment of the invention.
Figure 6:
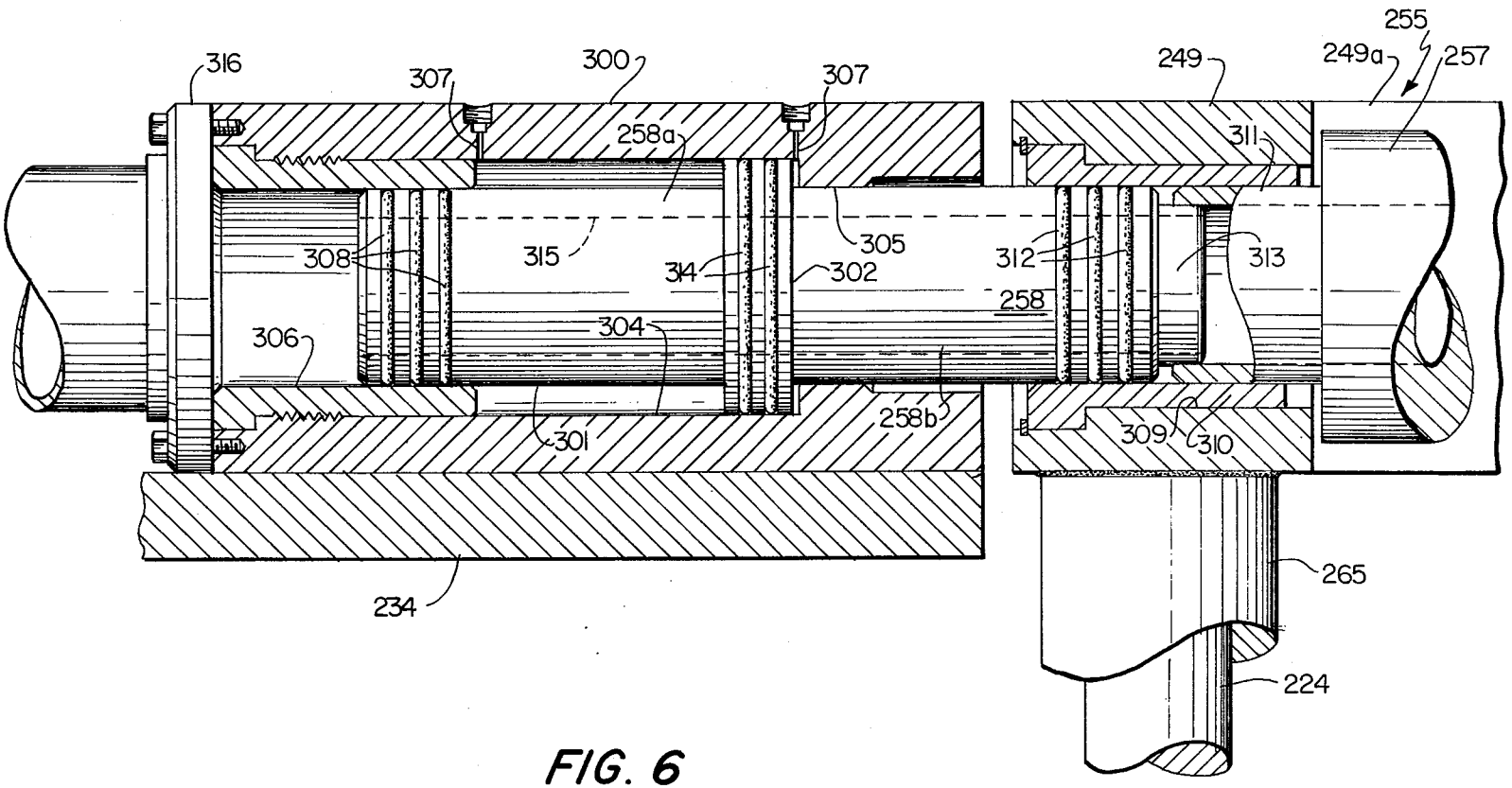
FIG. 6 is a fragmentary longitudinal sectional view illustrating details of a stinger type connection for the swivel employed in the apparatus of FIG. 5.

Connection of the flowline swivel to the conduits from, e.g., the christmas tree can be accomplished according to the invention without bodily shifting the swivel. Thus, as seen in FIGS. 5 and 6, the swivel assembly 255 includes two pivot blocks 249 arranged each at different end of the swivel 257 and each constructed to receive a stinger 258, FIG. 6, arranged for rectilinear movement in a stinger block 300. Stinger blocks 300 are rigidly mounted on christmas tree frame 234 and are spaced apart in coaxial alignment. Pivot blocks 249 are rigidly secured to a carried member 249*a* located on the side of the blocks nearer the flow unit assembly 232. Each block 249 is secured rigidly to one of two dependent locator tubes 265, tubes 265 being spaced apart by a distance such that, when the swivel assembly is lowered down the usual guide means (not shown) connected to the locator posts 210-210*c,* FIG. 5, each tube 265 telescopes downwardly over a different one of the two locator posts 224 carried by flowline base assembly 212, and pivot blocks 249 of the swivel assembly are thus accurately positioned relative to the stinger blocks 300.

Stingers 258 are disposed as pistons in the respective blocks 300 so that, once the swivel assembly has been landed, stingers 258 can be hydraulically actuated simultaneously to their engaged positions, seen in FIG. 6, in the respective pivot blocks 249. Each stinger 258, as seen in FIG. 6, comprises a right cylindrical body 301 having an integral portion 302 of enlarged diameter intermediate portion 303 cooperating as a piston with cylinder portion 304 of block 300. The effective length of cylinder portion 304 is defined by a transverse annular inwardly projecting shoulder 305 of block 300, on the one hand, and a sleeve 306, on the other hand, sleeve 306 being inserted in the outer end of the bore of block 300 and secured by threads, as shown. Ports 307 are provided at the respective ends of cylinder portion 304 for connection to conduits (not shown) for the supply and exhaust of hydraulic fluid under control from the operational base, such as a vessel (not shown) at the surface of the body of water.

Portion 258*a* of the stinger projects from piston portion 302 toward the end of the block 300 which accommodates sleeve 306. Portion 258*a* has a diameter such as to be slidably accommodated in sleeve 306, and seals are provided at 308 to seal between portion 258*a* and sleeve 306. Portion 258*b* of the stinger projects from piston portion 302 toward the adjacent pivot block 249 (when swivel assembly 255 has been installed). Pivot block 249 has a through bore 309 which is coaxial with the bore of stinger block 300 in the final installation, and bore 309 accommodates a sleeve 310 which serves both as a bushing in which the tubular stub shaft 311 of swivel 257 is journalled and as a receptacle to receive stinger portion 258*b.* Stinger portion 258*b* is equipped with seals at 312 to seal between stinger portion 258*b* and sleeve 310. At its tip, stinger portion 258*b* has a short portion 313 to be accommodated by the bore of stub shaft 311, as shown in FIG. 6. Piston portion 302 is provided with seals at 314 to seal between that portion and cylinder portion 304. Stinger 258 has a through bore 315. The bore of stub shaft 311 continues through the body of swivel 257 to communicate with the corresponding one of flowlines 201, 202. A flanged tubing connector 316, FIG. 6, is bolted to the end of stinger block 300 which accommodates sleeve 306, placing conduit 286 in communication with stinger bore 315.

Installation is otherwise generally as described for the embodiment shown in FIGS. 1-3 and, when installation has proceeded to the stage seen in FIG. 5, flowlines 201, 202 can be laid out on the floor of the body of water, with swivel 257 pivoting freely, about the axis defined by sleeve 310, FIG. 6, as the lay barge proceeds away from the operational base, and with the ultimate angular disposition of the flowlines at the swivel not being limited by the swivel structure.

It is to be noted that, in all three embodiments described, installation is accomplished by a method in which the flowline is attached to a swivel which has a flow passage which is coaxial with the axis of rotation of the swivel and with which the connected end of the flowline communicates, lowering to a predetermined position at the underwater installation a flow unit (such as the christmas tree) having a conduit terminating in a connector with which the flowline is to communicate, lowering the swivel, with flowline attached, into a predetermined position relative to the connector, remotely connecting the swivel to the connector so that the flow unit conduit is in communication with the flowline via the passage in the swivel, and then laying out the flowline, the swivel turning freely to the final position determined by the attached end of the flowline.

What is claimed is:

1. In an underwater installation of the type in which a flowline to be laid along the bottom of a body of water is connected to a flow unit which is supported adjacent the bottom of the body of water, the combination of a permenent base mounted adjacent the bottom of the body of water and comprising
- locator means in a fixed relation relative to the installation, and
- means for connection to elongated guide means to extend from the surface of the body of water to the underwater installation;

a flowline;

a flowline base assembly superimposed on said permanent base and comprising
- means operatively related to said locator means to locate said flowline base assembly in a predetermined position relative to said locator means,
- connector means, and
- swivel means;

one end of said flowline being connected to said swivel means;

said connector means, said swivel means and said flowline being arranged to establish a flow path for conducting fluid via said flowline when the installation is complete,
- said swivel means being constructed and arranged for free swivelling about a swivel axis which is aligned with a portion of said flow path;

a flow unit base superimposed on said flowline base assembly,
- said flow unit base carrying the flow unit of the underwater installation and including means operatively related to said locator means of said permanent base to locate the flow unit in a predetermined position relative to said locator means and therefore also in a predetermined position relative to said flowline base assembly; and remotely operated power means for establishing connection between the flow unit and said swivel means via said connector means.

2. An underwater installation according to claim 1, wherein said connector means comprises two cooperating connector members, one of said members being mounted on said flow unit base; and said flowline base assembly comprises a main frame, and a secondary frame, the other of said connector members being mounted on said secondary frame, said remotely operated power means being mounted on said main frame.

3. An underwater installation according to claim 2, wherein said main frame of said flowline base assembly is equipped with locator means; and said secondary frame of said flowline base assembly comprises means capable of coacting with said locator means on said main frame of said flowline base assembly, whereby said secondary frame can be landed on said main frame after said flow unit base has been landed.

4. An underwater installation according to claim 3, wherein said main frame of said flowline base assembly comprises a sub-frame arranged for rectilinear movement relative to the rest of said main frame, said locator means of said main frame being carried by said sub-frame, said remotely operated power means being constructed and arranged to move said sub-frame relative to said main frame.

5. An underwater installation according to claim 2 wherein the flow unit is a christmas tree having two flowloops and the flowloops terminate in remote ends which are spaced apart transversely relative to the flowline base and which open away from the christmas tree in the same direction, the installation comprising two connector means each comprising two connector members, one connector member of each of said connector means being connected to said remote end of a different one of said flowloops;

the other connector members of said two connector means being mounted on said flowline base assembly in mutually spaced apart relation and each aligned coaxially with a different one of said remote ends of said flowloops, said swivel means being located generally between said other connector members.

6. An underwater installation according to claim 5, comprising two flowlines, one end of each of said flowlines being connected to said swivel means.

7. An underwater installation according to claim 6, wherein said swivel means comprises two support members each having an aperture, said support members being mounted on said flowline base assembly and spaced apart with said apertures in mutual alignment, and a swivel member extending between said support members and journalled thereon for rotation about an axis determined by said aligned apertures.

said swivel member having two flow ducts each having one end opening through a different end of said swivel member and the other end opening laterally of the swivel member;

said ends of said flowlines each being connected to said swivel member at said other end of a different one of said flow ducts.

8. An underwater installation according to claim 7, wherein said other ends of said flow ducts are directed away from the axis of rotation of said swivel member at an acute angle, the end portions of said flowlines which are connected to said swivel member extending first at said acute angle and then curving away from said swivel member to extend away therefrom at right angles to the axis of rotation of said swivel member.

9. An underwater installation according to claim 8, and further comprising a cross-brace rigidly secured to and extending between said flowlines in a location spaced from said swivel means; and additional brace means extending generally parallel to said flowlines and rigidly secured to said cross-brace and to said swivel member.

10. An underwater well installation according to claim 1, wherein said swivel means comprises a swivel member having mutually coaxial shaft portions located each at a different end of the swivel member and two pivot blocks located each adjacent a different end of said swivel member, said pivot blocks each having a bearing in which the corresponding one of said shaft portions is journalled, one of said pivot blocks having a through passage which is coaxial with said stub shafts, said swivel member having a flow passage which opens outwardly at one end through the end of the shaft portion journalled in the bearing of said one pivot block and which opens outwardly at its other end through a intermediate portion of swivel member in a lateral direction, said one end of the flowline being rigidly secured to said swivel member in communication with said other end of the flow passage of said swivel member; and said connector means comprises a stinger block mounted adjacent to said one pivot block and including a stinger aligned coaxially with said through passage of said one pivot block, said stinger block and stinger coacting for rectilinear movement of said stinger into and out of engagement in said through passage in response to fluid pressure supplied to said stinger block, said stinger having an axial flow passage which communicates with the flow passage of said swivel member when the stinger is engaged in the through passage of said one pivot block.

11. In an underwater installation of the type in which a flow unit, such as the christmas tree of a well, is connected to a flowline which extends away from the installation and along the floor of the body of water, the combination of two support members mounted at the underwater installation in predetermined locations, said support members being spaced apart horizontally and each being equipped with a bearing, said bearings being mutually coaxial;

a swivel body located between said support members and having mutually coaxial shaft portions located each at a different end of the swivel body, each of said shaft portions being journalled in a different one of said bearings, whereby said swivel body is supported by said support members for free rotation about the axis defined by said bearings, said swivel body having a flow passge one end of which opens axially through the end of one of said shaft portions and the other end of which opens laterally through the swivel body in a location between said shaft portions, one end of the flowline being rigidly secured to said swivel body in communication with the other end of said flow passage; and conduit means equipped with remotely operated connector means for placing the flow passage of said swivel body in communication with the flow unit of the underwater installation.

12. The combination according to claim 11, wherein said conduit means includes a first conduit having one end secured to the one of said support members which supports said one shaft portion of the swivel body, said first conduit communicating with the flow passage of said swivel body, and a second conduit having one end connected to the flow unit of the underwater installation, said remotely operated connector means comprising a first connector member secured to the other end of said first conduit and a second connector member secured to the other end of said second conduit; and two independently retrievable frame means, said support members, said first conduit and said first connector member being carried by one of said frame means, said second conduit, said second connector member and the flow unit of the underwater installation being carried by the other of said frame means.

13. In the installation of a flowline in connection with an underwater installation located at a substantial distance below the surface of a body of water by the method comprising supporting the flowline on a vessel initially located in a position at least generally above the underwater installation, lowering an end of the flowline to the underwater installation, attaching the end of the flowline to the underwater installation, and then laying the flowline by moving the vessel away from its initial position while paying out the flowline, the improvement comprising installing at the underwater installation conduit means including a connector with which the flowline is to communicate, and locator means occupying a predetermined position relative to said connector;

connecting an end of the flowline to a swivel having a flow passage which is coaxial with the axis of rotation of the swivel and with which the connected end of the flowline communicates;

lowering said swivel into a predetermined position determined at the underwater installation by said locator means;

connecting this flow passage of the swivel to said connector; and laying the flowline away from the underwater installation, said swivel turning freely under the influence of said flowline until laying of the flowline has been completed, at which time the rotational position of the swivel is determined by the final disposition of the end portion of the flowline connected to the swivel.

14. In the installation of a flowline in connection with an underwater installation located at a substantial distance below the surface of a body of water by the method comprising supporting the flowline on a vessel initially located in a position at least generally above the underwater installation, lowering an end of the flowline to the underwater installation, attaching the end of the flowline to the underwater installation, and then laying the flowline by moving the vessel away from its initial position while paying out the flowline, the improvement comprising providing at the site of the underwater installation a permanent base equipped with locator means;

lowering onto the permanent base a flowline base while guiding the flowline base into a predetermined position relative to said locator means, the flowline base including a secondary unit mounted for movement from an initial position to a second position;

lowering a flow unit onto the flowline base while guiding the flow unit into a predetermined position relative to said locator means, the flow unit including a first conduit terminating in a connector member having a predetermined position relative to said locator means;

connecting an end of the flowline to a swivel which is mounted on a swivel frame and which includes a flow passage which is coaxial with the axis of rotation of the swivel and with which the connected end of the flowline communicates, the swivel frame also carrying a second flow conduit communicating with the flow passage of the swivel and terminating in a connector member capable of connection of the connector member of said first conduit;

lowering the swivel frame onto the secondary unit of the flowline base while guiding the swivel frame into a predetermined position relative to said locator means, in which position the connector member of said second flow conduit is aligned with the connector member of said second flow conduit;

shifting the secondary unit of the flow line base to connect said connector members and thereby place the flow unit in communication with the flowline via the flow passage of the swivel; and laying the flowline away from the underwater installation, the swivel turning freely under the influence of the flowline until laying of the flowline has been completed, at which time the rotational position of the swivel is determined by the final disposition of the end portion of the flowline connected to the swivel.

* * * * *